US006363911B1

(12) United States Patent
Reinhardt et al.

(10) Patent No.: US 6,363,911 B1
(45) Date of Patent: Apr. 2, 2002

(54) IMPLEMENT DRIVEN BY AN INTERNAL COMBUSTION ENGINE HAVING A CARBURETOR

(75) Inventors: Manfred Reinhardt, Korb; Axel Rauch, Heimerdingen, both of (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/545,523

(22) Filed: Apr. 7, 2000

(30) Foreign Application Priority Data

Apr. 8, 1999 (DE) ..... 199 15 783

(51) Int. Cl.[7] ..... F02B 77/08; F02D 11/04

(52) U.S. Cl. ..... 123/397; 123/198 DC; 123/400

(58) Field of Search ..... 123/198 D, 198 DB, 123/198 DC, 396, 397, 400

(56) References Cited

U.S. PATENT DOCUMENTS 3,791,366 A * 2/1974 MacMillan ..... 123/198 DB
4,757,786 A * 7/1988 Ellegard ..... 123/198 DC
5,092,295 A * 3/1992 Kobayashi ..... 123/198 DC

* cited by examiner

*Primary Examiner*—Tony M. Argenbright
(74) *Attorney, Agent, or Firm*—R. W. Becker & Associates; R. W. Becker

(57) ABSTRACT

An implement is provided that is driven by an internal combustion engine having sparked ignition and a carburetor. The implement has a first control device, for controlling engine power, that includes a throttle lever, a butterfly valve in the carburetor, a connecting element for operatively connecting the throttle lever and butterfly valve, and a restoring spring for automatically closing the butterfly valve in an uncoupled state of the connecting element. The implement also has a second control device for terminating ignition and for uncoupling the connecting element to uncouple the operative connection of the throttle valve and the butterfly valve.

17 Claims, 3 Drawing Sheets

IMPLEMENT DRIVEN BY AN INTERNAL COMBUSTION ENGINE HAVING A CARBURETOR

BACKGROUND OF THE INVENTION

The present invention relates to an implement that is driven by an internal combustion engine, such as an Otto engine having a carburetor. A first control device is provided for controlling engine power and includes a fuel selection device, a butterfly valve disposed in the carburetor, and a connecting element for operatively connecting the fuel selection device with the butterfly valve. A second control device is also provided for terminating ignition.

Such implements can be upright devices or manually guided devices and have the drawback that when ignition is terminated, with the butterfly valve partially or entirely opened, the drive motor continues running due to the momentum of its own mass or that of the movable mass connected thereto, thereby drawing in a certain amount of fuel/air mixture, which is not burned due to the fact that ignition has been terminated. This unburned fuel/air mixture leads to emissions that may not conform to the legal standards, and also to fouling of the carburetor and engine. In addition, when such emissions pass the hot exhaust components, especially when a catalytic converter is utilized, combustion and even explosions result that unnecessarily stress the device and pollute the environment with noise.

This negative effect is particularly critical for implements having a high flywheel mass. Especially with manually guided blowers, the high mass of the fan wheel blower, which without an intermediately disposed centrifugal force coupling is connected directly to the crankshaft, leads to a long slowing time. If during the slowing phase of the blower, while ignition has been terminated, the operator inadvertently operates the butterfly valve, a particularly high portion of unburned fuel is given off through the exhaust.

DE-OS 33 30 994 discloses a fuel valve in the fuel intake that is controlled by the underpressure that exists in the carburetor. Since due to the high rotational speed a considerable underpressure builds up in the carburetor during the slowing phase of the engine, the fuel valve can open unintentionally; the fuel that is drawn in is discharged without being burned.

It is therefore an object of the present invention to significantly limit the supply of fuel of an implement of the aforementioned general type in a straightforward manner when ignition is terminated.

BRIEF DESCRIPTION OF THE DRAWINGS

This object, and other objects and advantages of present invention, will appear more clearly from the following specification in conjunction with the accompanying schematic drawings, in which.

SUMMARY OF THE INVENTION

Figure 1:
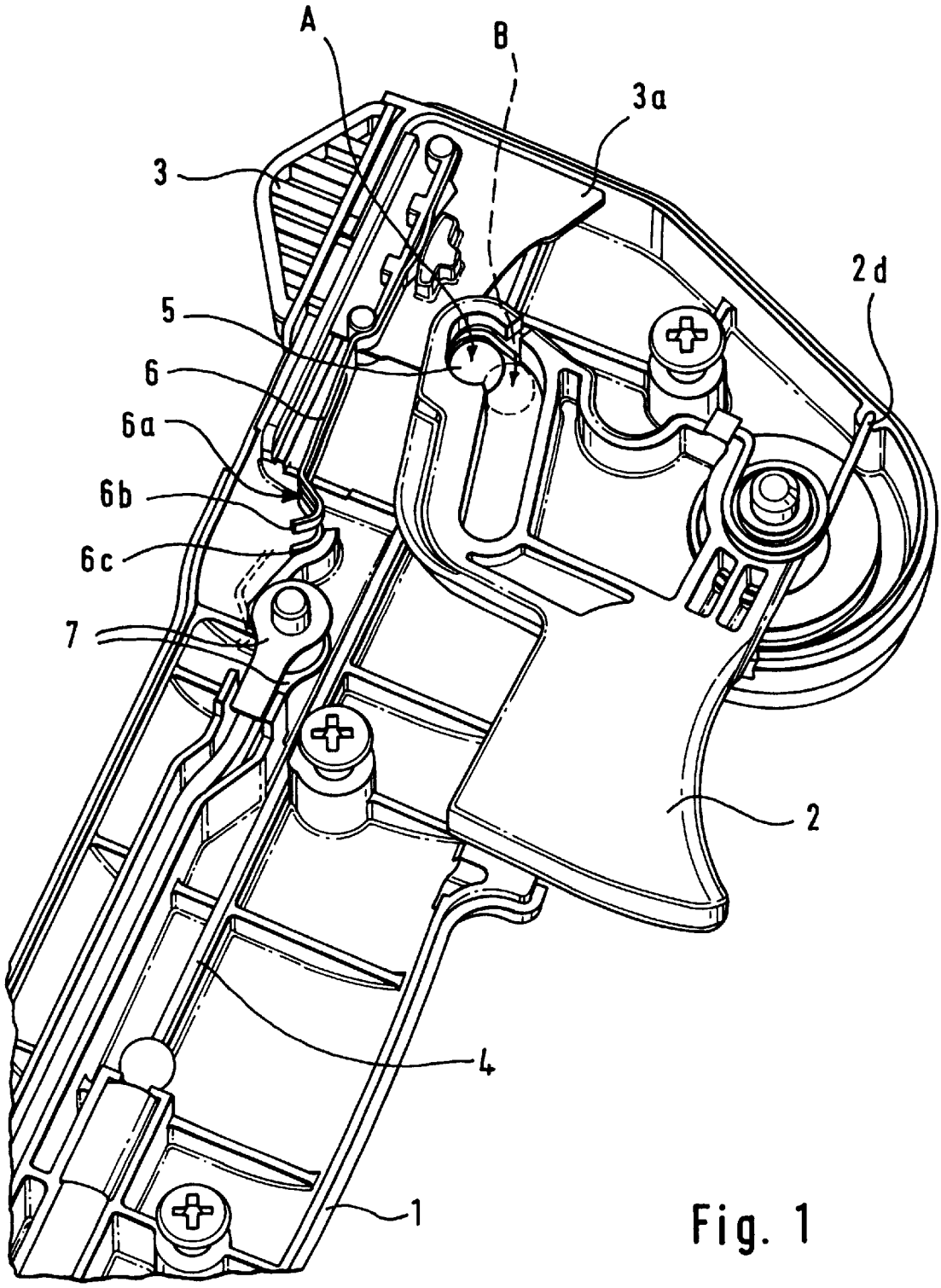
FIG. 1 in conjunction with one exemplary embodiment of the present invention, a perspective view of an opened control handle having disposed therein elements for fuel selection, ignition termination, and uncoupling of the connection between fuel lever and butterfly valve.

The implement of the present invention is characterized primarily in that the operative connection between the fuel lever and butterfly valve can be uncoupled by means of the second control device, and in that in the uncoupled state, the butterfly valve closes automatically by means of a restoring spring.

The basic concept of the present invention is that when ignition is terminated the butterfly valve will also be closed, thus limiting the supply of fuel to a minimum.

This can occur by means of a positive coupling of the control device that is intended for ignition termination with the butterfly valve. However, in order to avoid that the ignition terminator and the fuel lever unintentionally counteract one another, which can in particular occur when the fuel selection device and the control device for terminating ignition are disposed on a control handle in such a way that either one of the two can be activated by the thumb and index finger of a hand, the operative connection between the fuel selection device and the butterfly valve are preferably capable of being uncoupled by means of the control device for termination of ignition.

If a butterfly valve is provided that in the uncoupled state automatically closes due to spring force, then when the control device for interrupting the ignition is activated, the supply of fuel to the engine is effectively limited, or, depending upon the construction of the carburetor, can even be entirely eliminated.

For manually guided implements, the fuel selection device, for operation with the index finger, is preferably embodied as a fuel lever that is disposed in the control handle and is pivotable about an axis of rotation. With such implements, the control device for termination of ignition is advantageously embodied for control with the thumb and in particular, in conformity with the ergonomics of the thumb, is embodied as a linearly movable stop or cutoff slide that is disposed in the control handle.

In order to be able to operate the fuel lever and the cutoff slide with one hand, the fuel lever and cutoff slide are preferably disposed on opposite sides of the control handle of the implement. Especially with the last-mentioned configuration, it is advisable to make the operative connection between the fuel lever and the butterfly valve capable of being uncoupled by means of the cutoff slide at the connection location between the fuel lever and the connecting element.

In a straightforward construction, a reversible connection between the fuel lever and the connecting element that can be uncoupled can be provided by positively interconnecting the fuel lever and the connecting element in the direction of adjustment or control, preferably by means of a cylindrical coupling member that is connected to the connecting element.

In this manner, in the direction of adjustment the connecting element can be moved by the fuel lever, and can be uncoupled transverse to the direction of adjustment.

For an automatic recoupling, that end of the connecting element that faces the fuel lever is advantageously elastically movable transverse to its direction of actuation against a spring force, and in particular is embodied as a Bowden cable that is elastically resilient relevant to bending.

An L-shaped groove is expediently provided in the fuel lever for accommodating the coupling member that is connected to the connecting element. A first leg or segment of this groove is advantageously disposed in such a way that it has a side for receiving the coupling member in the engagement or drag position, with this side intersecting the line of application of the connecting element at an obtuse angle. Thus, in a direction of adjustment an interlocking is provided between the fuel lever and the coupling member while at the same time providing free movability transverse thereto. The second leg or segment of the L-shaped groove is preferably disposed at an acute angle or parallel to the direction of adjustment and has a length that is sufficient to form a free-running area for the coupling member in the uncoupled position. If at any position of the fuel lever the coupling member is placed in this free-running area, the butterfly valve, and the connecting element connected therewith, are automatically placed in the idle position by means of spring force. The center line of the free-running area is expediently laterally offset relevant to the line of application of the connecting element so that in the uncoupled position the connecting element is elastically resiliently prestressed transverse to the adjustment direction. As a result, when the fuel lever is returned to the idle position, the coupling member is automatically again arrested in the drag position.

The fuel lever is advantageously biased in the direction toward the idle position by means of a return spring since in the uncoupled state, the restoring force of the automatically closing butterfly valve is not present.

Pursuant to one advantageous embodiment of the cutoff slide, an inclined flank is connected thereto for cooperating with the coupling member. When the cutoff slide is actuated, this flank, pursuant to the principle of an inclined plane, presses the coupling member out of its drag position into the uncoupled position in the free-running area. In this connection, the flank is shaped in such a way that in the STOP position of the cutoff slide the flank presses the connecting element out of the drag position in every position of the fuel lever, and prevents an automatic rearresting in the idle position of the fuel lever. In this way, after termination of ignition and release of the fuel lever, the butterfly valve cannot be reopened by means of an unintentional contact of the fuel lever.

However, to start the engine the coupling member is self-arresting in the drag position upon positioning of the cutoff slide in the ON position and the fuel lever in the idle position.

To terminate the ignition, an electrical contact pair is expediently provided that is electrically conductively connectable by means of the cutoff slide, and in particular by means of a flat spring.

To produce defined positions, the cutoff slide is advantageously embodied in such a way that it can be arrested in a STOP and in an ON position. Particularly suitable is an arresting means that comprises two arresting recesses and a flat spring having an angled-off portion that engages in the arresting recesses. To reduce the complexity, only a single flat spring is advantageously provided not only for termination of ignition but also for arresting the cutoff slide and in particular is connected to the cutoff slide, while the arresting recesses and the electrical contact pair for termination of ignition are fixedly disposed on the housing.

To simplify assembly, the flat spring is preferably interlockingly connected to the cutoff slide. To prevent an undefined intermediate position from being possible between the STOP and ON positions of the cutoff slide defined by the arresting recesses, a ramp that is fixed to the housing and that cooperates with the angled-off portion of the flat spring is advantageously provided between the two arresting recesses.

The electrical contact pair for termination of ignition is preferably disposed in the base of the arresting recess that defines the STOP position. This ensures that by means of the angled-off portion of the flat spring arresting and electrical contact can be simultaneously established in the same position of the cutoff slide.

To compensate for slight misalignments of the electrical contact pair, the flat spring is advantageously longitudinally divided into two individual spring ends at the site of the angled-off portion.

Further specific features of the present invention will be described in detail subsequently.

DESCRIPTION OF PREFERRED EMBODIMENTS

Figure 2:
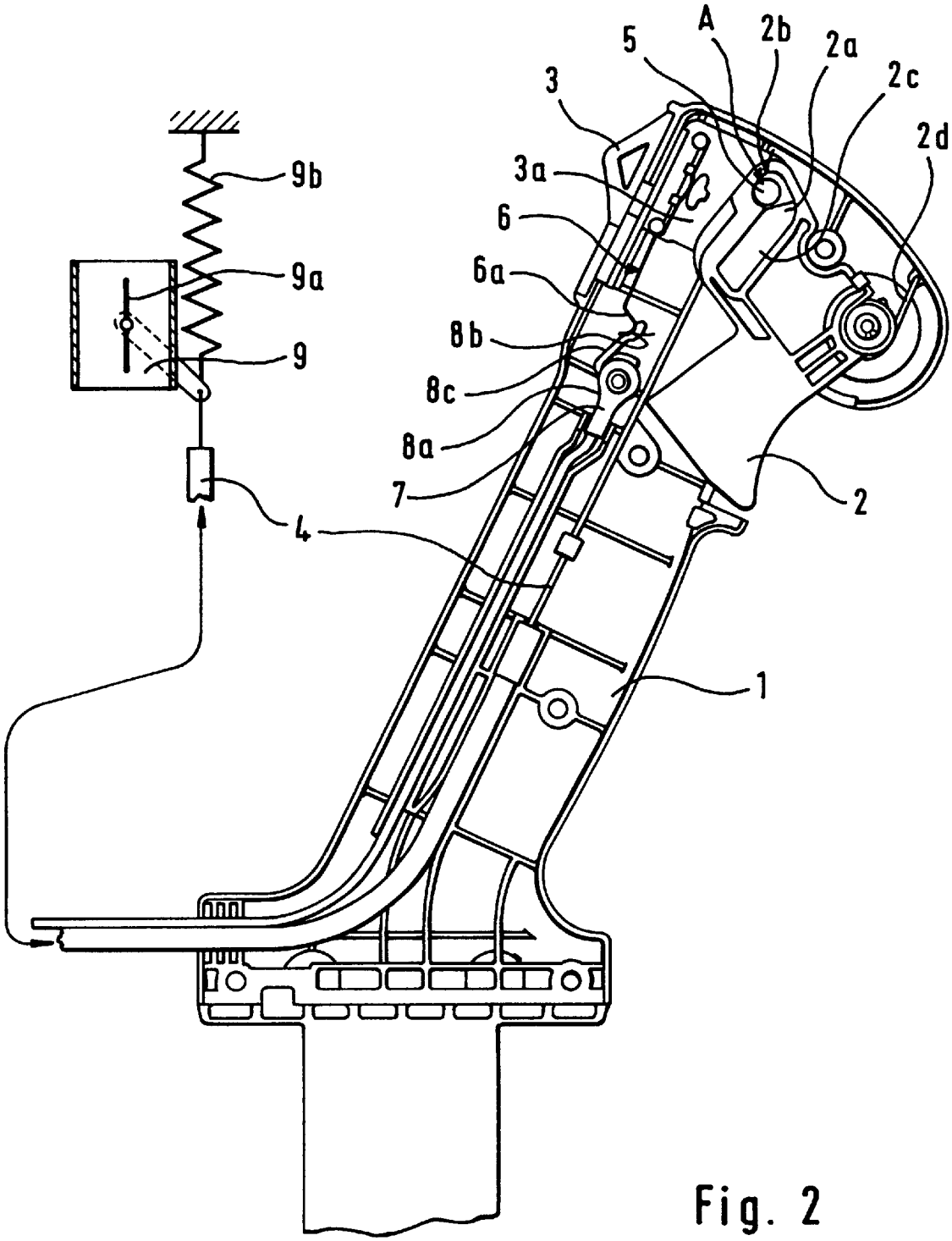
FIG. 2 a cross-sectional view through the control handle with the coupling member in the drag position, the fuel lever in the full throttle position, and a schematic illustration of a carburetor with the butterfly valve opened.
Figure 3:
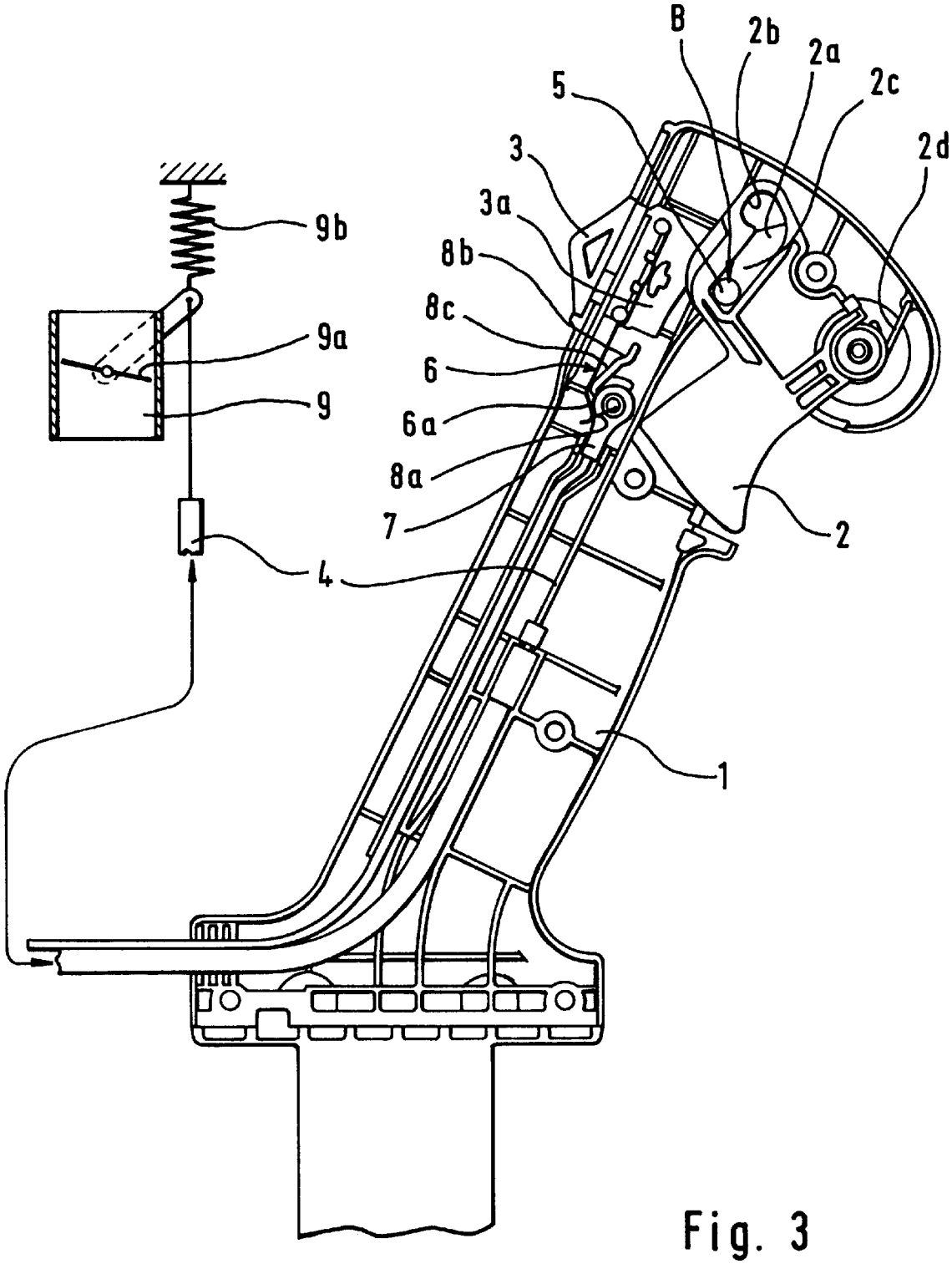
FIG. 3 a view similar to that of FIG. 2, but with the coupling member in the uncoupled position and with the butterfly valve closed.

Referring now to the drawings in detail, FIGS. 1 to 3 illustrate an operative connection between a fuel selection device 2 and a carburetor 9; this operative connection can be uncoupled by means of a control device that is provided for terminating the ignition. Pursuant to FIGS. 2 and 3, the throttle or butterfly valve 9*a* of the carburetor 9 is connected to a restoring spring 9*b* in such a way that in the uncoupled state it automatically closes.

The fuel selection device 2 can be a pedal, a lever, a linearly moveable slide, a rotary knob or a rotary handle. With manually guided implements, as illustrated here, so that it can be operated with the index finger it is preferably embodied as a throttle or fuel lever 2 that is disposed in the control handle 1 and is pivotable about an axis of rotation.

The control device for terminating the ignition can be a toggle or rotary switch. With manually guided implements, the control device is advantageously embodied as a linearly movable stop or cutoff slide 3 that is disposed in the control handle 1 of the implement.

The fuel lever 2 and the cutoff slide 3 are preferably disposed on opposite sides of the control handle 1.

The connection between the fuel lever 2 and the butterfly valve 9*a* can also be made such that it can be uncoupled at the carburetor 9. Due to the spatial proximity of the cutoff slide 3 to the fuel lever 2, it is expedient to embody the operative connection between the fuel lever 2 and the butterfly valve 9*a* in such a way that it can be uncoupled by means of the cutoff slide 3 at the connection location between the fuel lever 2 and the connecting element 4.

A connection between the fuel lever 2 and the connecting element 4 that is capable of being uncoupled can be effected hydraulically, pneumatically, magnetically or electrically. A connection that can be mechanically uncoupled is advantageous; in other words, a connection that in the control direction is a positive connection and transverse thereto is freely movable. Particularly suitable for this purpose is a cylindrical coupling member 5 that is connected to the connecting element 4.

That end of the connecting element 4 that faces the fuel lever 2 is advantageously elastically movable against a spring force transverse to its direction of actuation. Such a connecting element 4 can therefore be embodied as a wire linkage. However, in conformity with the embodiment illustrated in FIGS. 1 to 3, the connecting element 4 is preferably embodied as a Bowden cable that with regard to bending is elastically resilient.

An L-shaped groove 2*a* is expediently provided in the fuel lever 2 for receiving the coupling member 5 that is connected to the Bowden cable 4. The engagement or drag segment 2*b* formed by the groove 2*a* is disposed in such a way that it intersects the line of application of the cable 4 at an obtuse angle and thus forms a receiving area for the coupling member 5 in the drag position A. The second segment or leg of the L-shaped groove 2*a* is preferably disposed at an acute angle or parallel to the direction of control and thus forms a free-running area 2*c* for the coupling member 5 in the uncoupled position B. The center line of the free-running area 2*c* is expediently laterally offset relative to the line of application of the Bowden cable 4 so that in the uncoupled position the cable 4 is elastically resiliently prestressed transverse to the direction of control.

FIG. 3 shows the cutoff slide 3 in the STOP position and the coupling member 5 in the disengaged position B. Thus, the fuel lever 2, which is in the full throttle position, is not drawn back to the idle position by the force of the restoring spring 9*b* when it is released. For this reason, the fuel lever 2 is advantageously biased in an idle direction by means of a return spring 2*d*.

The cutoff slide 3 is provided with a flank 3*a* that is connected thereto. In the ON position of the slide 3 shown in FIG. 2, the coupling member 5, which is disposed in the drag position A, is freely movable over the entire adjustment path of the Bowden cable 4 in the direction of actuation thereof. In the illustrated full throttle position of the fuel lever 2, the butterfly valve 9*a* of the carburetor 9 is open via the connection with the Bowden cable 4. In this connection, the flank 3*a* of the cutoff slide 3 is shaped in such a way that in any position of the fuel lever 2, for example in the full throttle position of FIG. 3, by disposing the cutoff slide 3 in the STOP position the coupling member 5 is pressed out of its drag position A (FIG. 2) into the free-running area 2*c*, and by means of the force of the spring 9*b* is drawn into its uncoupled position B (FIG. 3). Due to the force of the spring 9*b* the butterfly valve 9*a* of the carburetor 9 is self-closing. By placing the cutoff slide 3 in the ON position, and by placing the fuel lever 2 in the idle position, pursuant to FIG. 1 the coupling member 5 automatically engages in the drag position A due to the bending spring force of the Bowden cable 4.

Pursuant to FIG. 1, an electrical contact pair 7 is expediently provided for termination of the ignition; the contact pair can be electrically conductively connected by the cutoff slide 3, and in particular via a flat spring 6. To provide defined positions, the cutoff slide 3 is advantageously embodied in such a way that it can be arrested in a STOP position and an ON position. Particularly suitable is an arresting means that comprises two arresting recesses 8*a* and 8*b*, with the flat spring 6 being provided with an angled-off portion 6*a* for engaging the arresting recesses. Advantageously, only a single flat spring 6 is provided not only for terminating the ignition but also for arresting the cutoff slide 3. The electrical contact pair 7 and the arresting recesses 8*a* and 8*b* can be provided on the cutoff slide 3; in the illustrated embodiment, they are provided on the housing, while the flat spring 6 is secured to the cutoff slide 3. For example, the flat spring 6 can be welded or screwed to the cutoff slide 3. To simplify assembly, this securement is form-locking. To prevent an undefined intermediate position from being possible between the STOP and ON positions of the cutoff slide 3 as defined by the arresting recesses 8*a* and 8*b*, a ramp 8*c* that cooperates with the angled-off spring portion 6*a* is provided on the housing between the two arresting recesses 8*a* and 8*b*.

Pursuant to FIGS. 2 and 3, the electrical contact pair 7 for terminating the ignition is preferably disposed in the base region of the arresting recess 8*a* that defines the STOP position. As shown in FIG. 1, to compensate for slight misalignments of the electrical contact pair 7, the flat spring 6 is advantageously longitudinally divided into two individual spring ends 6*b* and 3*c* at the site of the angled-off portion 6*a*.

The specification incorporates by reference the disclosure of German priority document 199 15 783.9 of 8 Apr. 8, 1999.

The present invention is, of course, in no way restricted to the specific disclosure of the specification and drawings, but also encompasses any modifications within the scope of the appended claims.

What we claim is:

1. An implement that is driven by an internal combustion engine having spark ignition and a carburetor, said implement comprising:

a first control device, for controlling engine power, that includes a throttle lever, a butterfly valve in the carburetor, a connecting element for operatively connecting the throttle lever and butterfly valve, a restoring spring for automatically closing the butterfly valve in an uncoupled state of said connecting element; and a second control device for terminating ignition and for uncoupling said connecting element to uncouple an operative connection of said throttle lever and said butterfly valve.

2. An implement according to claim 1, wherein uncoupling of said operative connection is provided at a connection location between said throttle lever and said connecting element.

3. An implement according to claim 1, wherein said second control device is a linearly movable cutoff slide, and wherein said throttle lever and said cutoff slide are disposed on a control handle of said implement.

4. An implement according to claim 3, wherein said throttle lever and said cutoff slide are disposed on opposite sides of said control handle.

5. An implement according to claim 3, wherein a coupling member is connected to said connecting element for providing an interlocking connection between said throttle lever and said connecting element in a direction of adjustment, and wherein an end of said connecting element that faces said throttle lever is elastically movable against a spring force transverse to a direction of actuation of said connecting element.

6. An implement according to claim 5, wherein said coupling member is cylindrical, and wherein said connecting element is a Bowden cable that is elastically resilient with regard to bending.

7. An implement according to claim 5, wherein said throttle lever is provided with an L-shaped groove for accommodating said coupling member, wherein said L-shaped groove has a first segment that has a side for receiving said coupling member in a drag position and that intersects a line of application of said connecting element at an obtuse angle, wherein said L-shaped groove has a second segment that forms a free-running area for said coupling member in an uncoupled position thereof, and wherein a center line of said free-running area is laterally offset from, and extends at an acute angle or parallel to said line of application of said connecting element.

8. An implement according to claim 5, which includes a return spring for biasing and throttle lever in a direction toward an idle position.

9. An implement according to claim 5, wherein said cutoff slide has a flank that cooperates with said coupling member for pressing said coupling member out of a drag position thereof into an uncoupled position thereof.

10. An implement according to claim 5, wherein an electrical contact pair is provided that is electrically conductively connectable by means of said cutoff slide for termination of ignition.

11. An implement according to claim 10, wherein a flat spring is provided to effect said electrical conductivity of said electrical contact pair.

12. An implement according to claim 10, wherein means are provided for arresting said cutoff slide in an ON position and in a STOP position.

13. An implement according to claim 12, wherein said means for arresting said cutoff slide comprises a flat spring that cooperates with two arresting recesses, wherein said flat spring has an angled-off portion that engages said arresting recesses, and wherein a single flat spring is provided not only for terminating ignition but also for arresting said cutoff slide.

14. An implement according to claim 13, wherein said electrical contact pair and said arresting recesses, are provided on a housing of said control handle, and wherein said flat spring is provided on said cutoff slide.

15. An implement according to claim 14, wherein a ramp that cooperates with said angled-off portion of said flat spring is provided on said housing of said control handle between said arresting recesses, and wherein said electrical contact pair is disposed in a base region of one of said arresting recesses.

16. An implement according to claim 13, wherein said flat spring is longitudinally divided into two individual spring ends at the site of said angled-off portion of said flat spring.

17. An implement according to claim 14, wherein said flat spring is provided on said cutoff slide in an interlocking manner.

* * * * *